US005360386A

United States Patent [19]

Brumfield

[11] Patent Number: 5,360,386

[45] Date of Patent: Nov. 1, 1994

[54] STRENGTH COMPETITION APPARATUS

[76] Inventor: Robert L. Brumfield, 2822 Twenty-Eighth St., SE., #3, Washington, D.C. 20020

[21] Appl. No.: 130,457

[22] Filed: Oct. 1, 1993

[51] Int. Cl.[5] ..... A63B 21/00

[52] U.S. Cl. ..... 482/133; 482/906

[58] Field of Search ..... 482/92, 906, 133, 142, 482/907, 135, 131, 132; 472/106, 118, 120, 125

[56] References Cited

U.S. PATENT DOCUMENTS 4,627,617 12/1986 Gilmore et al. ..... 482/906 X
4,768,777 9/1988 Yang ..... 482/133 X
5,224,902 7/1993 Stremler ..... 472/118

*Primary Examiner*—Richard J. Apley
*Assistant Examiner*—Glenn E. Richman
*Attorney, Agent, or Firm*—Antonelli, Terry, Stout & Kraus

[57] ABSTRACT

A strength competition apparatus for pitting the entire bodily strength of one competitor against that of another. Each competitor is seated and operates an advancer for advancing his/herself in a relative forward direction using the advancer to apply leverage along a pair of transverse rails having a series of holes disposed within provided as part of the framework of the strength competition apparatus. By using the advancer to apply leverage against the transverse rails of the framework of the apparatus, each competitor attempts to prevent the opposing competitor from advancing forward as well. The present strength competition apparatus enables a competitor to engage in competition which pits his/her entire brute strength, of both the upper body and lower body, against that of another.

10 Claims, 3 Drawing Sheets

STRENGTH COMPETITION APPARATUS

BACKGROUND OF THE INVENTION

The present invention relates to a strength competition apparatus which pits the brute strength of one competitor against that of another.

Throughout history, man has devised various forms and means for competing against one another to test his strength and endurance. These competitions range from the ancient Greek Olympics to the present-day made-for-television competition series "American Gladiators."

However, access to such competition is usually reserved for a select few, highly-trained athletes. That is, the common "every-man" is unable to engage in such contests of strength and endurance.

SUMMARY OF THE INVENTION

An object of the present invention is to provide a strength competition apparatus that allows a competitor to pit his/her entire bodily strength against that of another competitor.

Another object of the present invention is to provide a strength competition apparatus means for two competitors to pit their entire bodily strength against of the other in test of brute strength and endurance.

In the present strength competition apparatus, opposing competitors face one another while sitting in symmetrical seating apparatuses. Each competitor is securely fastened into his/her seating apparatus by a seat belt and a foot support to which the competitors' feet are securely fastened. The respective seating apparatuses may be interconnected by an interlocking frame.

Transverse action frames extend, in a parallel fashion, along both the left and right sides of both competitors at waist level. Both action frames contain a series of holes evenly spaced throughout the entire length thereof. In addition, both competitors are provided with a pair of action bars, having a handle thereon, which can easily fit within the holes of the action frame.

Upon a starting signal from a referee, each competitor attempts to advance his/herself in a forward direction in opposition to the opposing competitor who is attempting to do the same. The competitors advance themselves in a forward direction by propelling themselves ahead using the action bar of one hand for leverage while inserting the action bar of the other hand in an action frame hole located further along the action frame.

This competition tests both upper body strength and lower body strength of the competitors since leverage is essential for forward advancement. The winner is determined when one of the competitors has advanced his/herself to the opposing end of the sliding seat track or having passed a designated marker.

DESCRIPTION OF THE PREFERRED EMBODIMENT

Figure 1B:
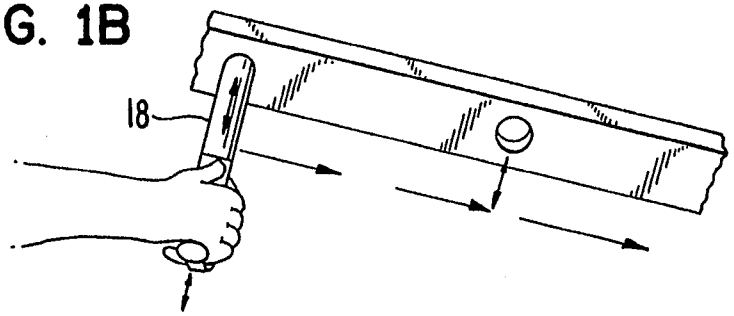
FIGS. 1A and 1B depict a side view of the preferred embodiment of the strength competition apparatus and the action bar and frame of the invention, respectively.
Figure 1A:
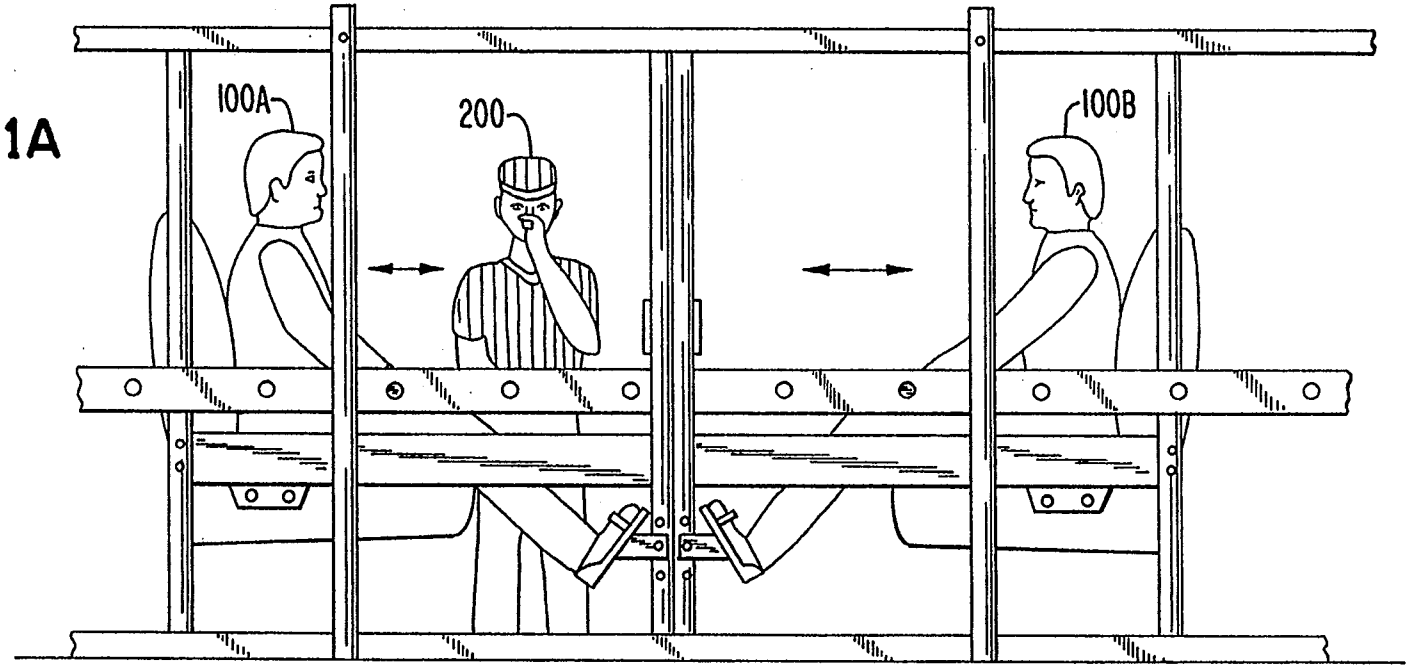

As seen in FIG. 1A, opposing competitors 100A and 100B are seated in their respective seating apparatuses. Upon the starting signal of referee 200, the competitors will attempt to advance themselves forward using the action bar 18 of one hand to provide leverage thereby enabling the advancement of the action bar of the other hand to provide further leverage. FIG. 1B depicts the action bar placement and advancement of the left hand of competitor 100A.

Figure 2:
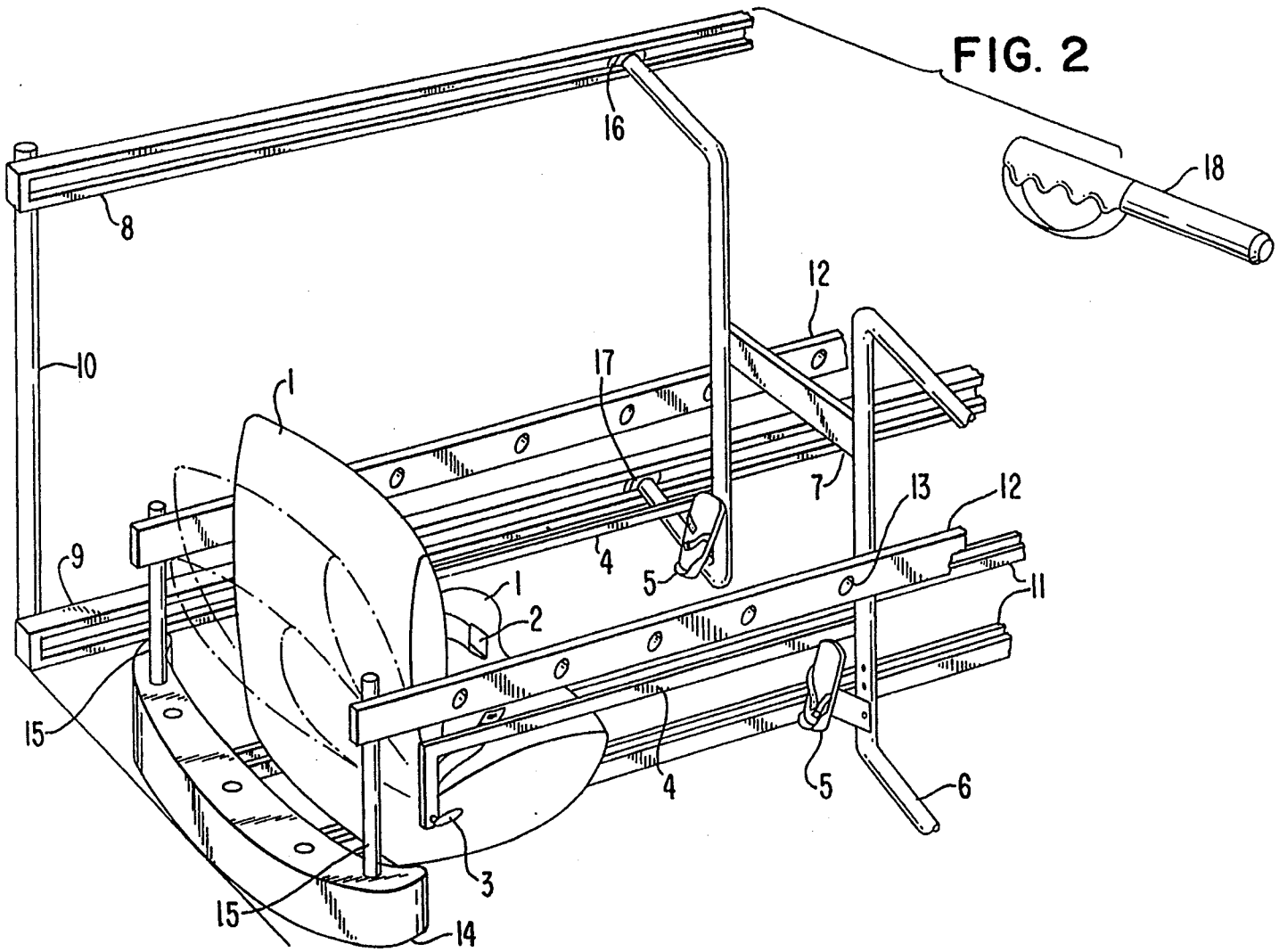
FIG. 2 depicts a detailed view of an individual seating apparatus and its attachment to the overall framework of the invention.

FIG. 2 shows a detailed embodiment of the seating apparatus in which each competitor sits. The competitor sits on seat 1, and is securely fastened therein by seat belt 2. Furthermore, the competitors' feet are securely fastened into foot supports 5 to provide further leverage. Each competitor will fit comfortably within the seating apparatus with respect to the foot supports 5, since the seat 1 is slidable along the seat tracks 11. Each seat is adjustable to recline at various angles by adjustment of seat adjustment lever 3.

Foot supports 5 are attached to seat frame 6 on both the left and right sides of the competitor. Seat 1 is disposed, with respect to seat frame 6, by means of seat attachment rail 4. Seat frame 6, on the left and right hand sides of the competitor, is stabilized by the central disposition of seat frame cross-bar 7.

In addition to seat 1 being slidable along seat tracks 11, the entire seat frame is slidable on upper seat roller 16 and lower seat roller 17, which fit within the tracks of upper seat rail 8 and lower seat rail 9, respectively. Upper seat rail 8 and lower seat rail 9 are interconnected and stabilized by structure frame stand 10 which further extends downward to the base of the apparatus. The contestants insert action bars 18 into the action frame hole 13 to advance both the contestant and his/her seating apparatus in a forward direction, or to prevent his/her opponent from doing the same. Holes 13 are provided at equal distances along the entire the length of action frames 12, which run in a transverse direction, in a parallel manner, on both the left and right hand sides of both contestants.

Each contestant must utilize his/her entire bodily strength to either advance his/herself in a forward direction or to prevent the opponent from doing the same. To advance him/herself in a forward direction, each competitor must use the action bars 18 to provide leverage for such advancement by further leveraging him/herself using the foot supports 5.

The winner of the strength competition is determined when one of the competitors has forced his/her opponent past a designated mark or to the end of the losing competitor's seat tracks 11 which are provided with a seat track bumper 14 at its respective distal end. The seat track bumper 14 also serves as a support frame for the seat tracks 11 and the action frames 12. The action frames 12 are held in place by the seat track support frame stands 15.

Figure 3:
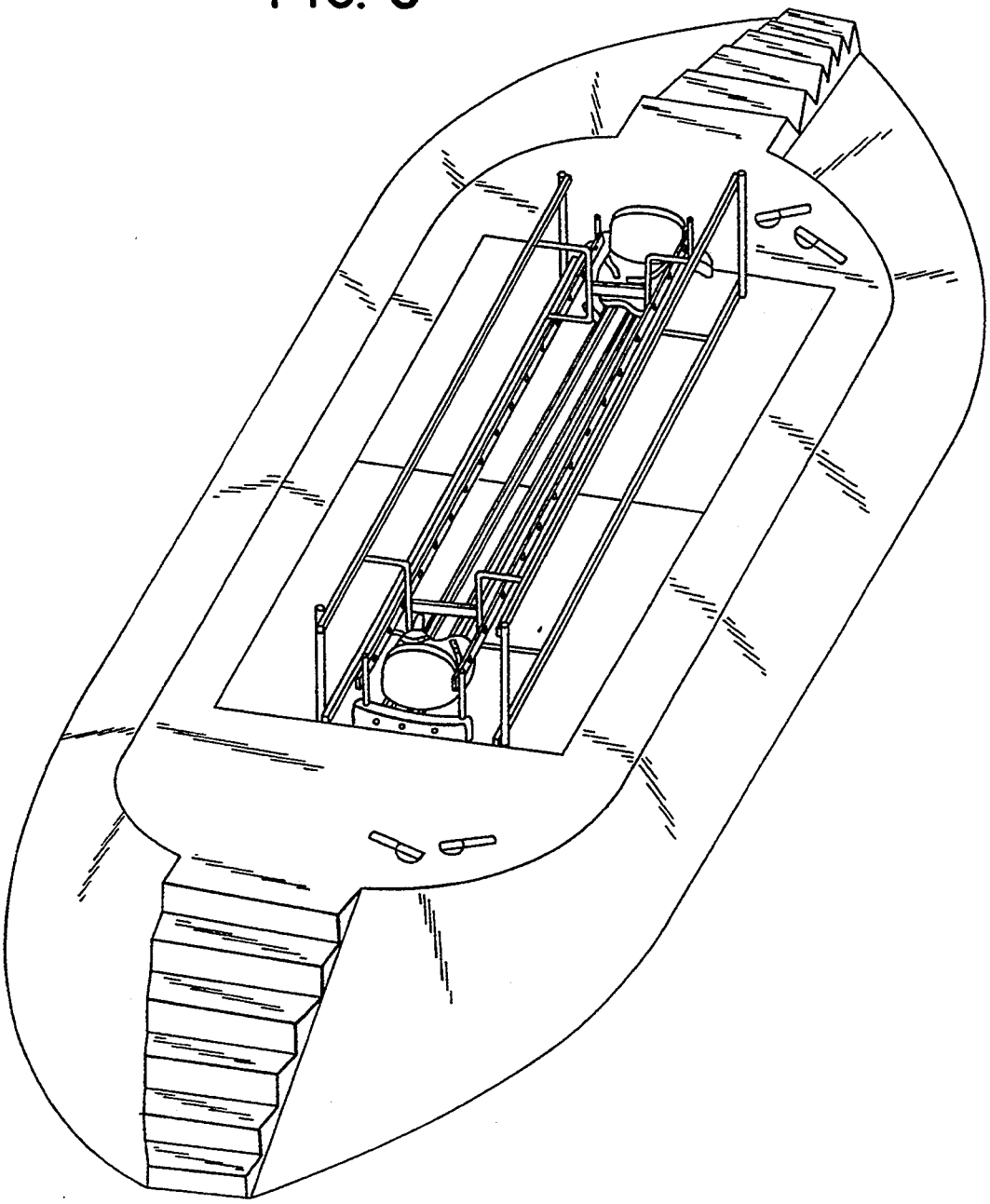
FIG. 3 depicts an overhead view of the overall strength competition apparatus of the present invention.

FIG. 3 depicts an overhead view of the entire strength competition apparatus. The strength competition apparatus can be disposed in an easily accessible location such as a tavern, bar or amusement hall. The strength competition apparatus may also be disposed in a stadium setting and form the basis of an organized sports activity such as tournaments, leagues or the like. Competitors need only to step inside the framework of the strength competition apparatus and secure themselves within using the seat belt 2 and foot straps 5.

Accordingly, the present invention provides a strength competition apparatus for pitting the brute strength of opposing competitors against one another. The present invention provides a test for complete bodily strength, by requiring upper body strength and lower body strength for leverage purposes.

Many different embodiments of the present invention may be constructed without departing from the spirit and scope of the invention. It should be understood that the present invention is not limited to the specific embodiments described in this specification. To the contrary, the present invention is intended to cover various modifications and equivalent arrangements included within the spirit and scope of the claims.

What is claimed is:

1. A strength competition apparatus for conducting a strength competition, comprising:

a stationary framework;

a movable first seating means for seating a first competitor within said framework;

first seat advancing means, operative by said first competitor, for advancing said first competitor along said framework, in said first seating means, in a first coaxial direction and preventing movement thereof in a second coaxial direction, said first advancing means advancing said first competitor by permitting said first competitor to apply leverage against said framework;

a moveable second seating means for seating a second competitor within said stationary framework; and second seat advancing means, operative by said second competitor, for advancing said second competitor along said framework, in said second seating means, in said second coaxial direction and preventing movement thereof in said first coaxial direction, said second advancing means advancing said second competitor by permitting said second competitor to apply leverage against said framework.

2. A strength competition apparatus, as claimed in claim 1, wherein said framework comprises a common track along which first and second seating means are each slidable in said first and second directions.

3. A strength competition apparatus, as claimed in claim 2, wherein said common track comprises bumpers at first and second distal ends, thereof.

4. A strength competition apparatus, as claimed in claim 1, wherein said first and second advancing means includes handles for insertion in holes transversely displaced along said framework of said apparatus.

5. A strength competition apparatus, as claimed in claim 1, wherein either of said first competitor and said second competitor win said strength competition when either of said competitors has pushed the other of said competitors beyond a designated mark on said framework.

6. A strength competition apparatus, as claimed in claim 1, wherein said first and second seating means comprise seat belt means for securing said first and second competitors to said first and second seating means, respectively.

7. A strength competition apparatus, as claimed in claim 6, wherein said first and second seating means comprise foot rests having footstraps thereon for securing said first and second competitors to said first and second seating means, respectively.

8. A strength competition apparatus, as claimed in claim 1, wherein said first and second seating means face one another and are interlocked independent of said framework.

9. A strength competition apparatus, as claimed in claim 1, wherein said first and second seating means both comprise upper roller and lower rollers slidably coupled to said framework for advancing said first and second seating means in said first and second directions.

10. A strength competition apparatus, as claimed in claim 1, wherein said first and second seating means are adjustable for reclining.

* * * * *